US006044658A

United States Patent [19]

Ryu

[11] Patent Number: 6,044,658

[45] Date of Patent: Apr. 4, 2000

[54] AUTOMATIC ICE MAKING APPARATUS FOR USE IN A REFRIGERATOR

[75] Inventor: Gang Ryu, Incheon, Rep. of Korea

[73] Assignee: Daewoo Electronics Co., Ltd., Rep. of Korea

[21] Appl. No.: 09/196,359

[22] Filed: Nov. 19, 1998

[30] Foreign Application Priority Data

Dec. 13, 1997 [KR] Rep. of Korea ..... 97-68496

[51] Int. Cl.[7] ..... F25C 5/06

[52] U.S. Cl. ..... 62/353; 62/72

[58] Field of Search ..... 62/72, 353

[56] References Cited

U.S. PATENT DOCUMENTS 3,727,426 4/1973 Kesling ..... 62/72

3,929,256 12/1975 Solomon ..... 62/72

4,306,423 12/1981 Webb et al. ..... 62/72

*Primary Examiner*—William E. Tapolcai

*Attorney, Agent, or Firm*—Pennie & Edmonds LLP

[57] ABSTRACT

An ice removing mechanism includes an ice tray having a fixing projection at one end thereof and a sliding projection at the other end thereof, a rotating guide plate having a fixing groove at one side thereof to guide the fixing projection of the ice tray inserted thereinto and a connecting shaft rotatably connected to an output shaft of a motor at the other side thereof, a fixing guide plate having a guide groove concentrically disposed to a center thereof, a twisting member disposed between the guide plates, and a movable stopper for preventing the ice tray from rocking from side to side. When the rotating guide plate is rotated, the sliding projection of the ice tray is rotated to slide along the sliding groove of the fixing guide plate, thereby pressing a bottom surface of the rotated ice tray. As a result, the ice cubes are effectively removed from the ice tray.

3 Claims, 5 Drawing Sheets

AUTOMATIC ICE MAKING APPARATUS FOR USE IN A REFRIGERATOR

FIELD OF THE INVENTION

The present invention relates to an automatic ice making apparatus; and, more particularly, to an automatic ice making apparatus incorporating therein an ice removing mechanism capable of effectively removing ice cubes from an ice tray.

DESCRIPTION OF THE PRIOR ART

One of the well known refrigerators is provided with an automatic ice making apparatus wherein water supplied by a water supplying device to an ice tray rotatably installed is frozen to form ice cubes and then the ice cubes are separated from the ice tray to be deposited into a subjacent restore bin.

There is shown in FIG. 1 a refrigerator provided with an ice making apparatus. As shown, such a refrigerator 1 is divided into a freezing chamber 2, a refrigerating chamber 4, and a ice making chamber 6 therebetween. The ice making apparatus includes an ice maker 10 installed in the ice making chamber 6 and a water supplying device 20 installed in the refrigerating chamber 4.

In FIG. 2, the ice maker 10 employed in the ice making apparatus in FIG. 1 is shown in detail. The ice maker 10 includes a housing 11 incorporating a motor 12 and a printed circuit board 13 for operating the motor 12, and a gear mechanism 14 for increasing and reducing the driving force of the motor 12, an output shaft 15 for outputting the increased and reduced driving force, a rotating shaft 16 connected to the output shaft 15, an ice tray 17 rotatably mounted on the rotating shaft 16, a supporting frame 18 for supporting the ice tray 17, and a sensing means(not shown) for sensing the rotating condition of the output shaft 15. Further, the ice maker 10 is provided with a full ice condition sensing lever 30 for sensing whether or not a full ice of a restore bin 40 is filled with ice cubes. The water supplying device 20 is capable of repeatedly delivering a predetermined amount of, e.g., 105±15 cc to the ice tray 17 via a supply conduit 22 (FIG. 1).

When the water supplied to the ice tray 17 as shown in FIG. 3A is frozen to form ice cubes, the ice tray 17 is turned until a projection 19 of the ice tray 17 is in contact with contacting surface 18*a* of the supporting frame 18 as shown in FIG. 3B. Thereafter, the ice tray 17 is twisted to remove the ice cubes therefrom, depositing them on the restore bin 40. The ice tray 17 is then overturned again to receive the water. These operations are repeatedly performed until a predetermined amount of the ice cubes is collected in the restore bin 40.

However, in the prior art ice removing mechanism, since the ice tray 17 is twisted by a driving force of the motor 12, it has a shortcoming in that the ice tray 17 made of plastic resin tends to break easily. Further, an idling of the motor 12 occurs during the twisting of the ice tray 17, which, in turn, may shorten the motor's life. Furthermore, since a twisting force provided by the motor 12 is weak, an additional heater needs to separate the ice cubes firmly adhered to each of cavities of the ice tray 17, thereby increasing an overall manufacturing cost thereof.

SUMMARY OF THE INVENTION

It is, therefore, a primary object of the present invention to provide an ice making apparatus for use in a is refrigerator incorporating therein an ice removing mechanism capable of performing an ice removing operation reliably without idling a motor.

In accordance with a preferred embodiment of the present invention, there is provided an ice making apparatus for use in a refrigerator incorporating therein an ice removing mechanism having a motor and an output shaft connected thereto, the ice removing mechanism comprising:

an ice tray having a fixing projection at one end thereof and a sliding projection at the other end thereof;

means for twisting the ice tray and connected to the output shaft of the motor; and a movable stopper for preventing the ice tray from rocking from side to side, wherein the twisting means includes a rotating guide plate having a fixing groove at one side thereof to guide the fixing projection of the ice tray inserted thereinto and a connecting shaft rotatably connected to the output shaft at the other side thereof, a fixing guide plate having a guide groove concentrically disposed to a center thereof so as to allow the sliding projection of the ice tray to slide along the guide groove, and a twisting member mounted between the rotating plate and the fixing plate to press a bottom surface of the rotated ice tray to thereby remove ice cubes from the ice tray.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE PREFERRED EMBODIMENTS

Figure 1:
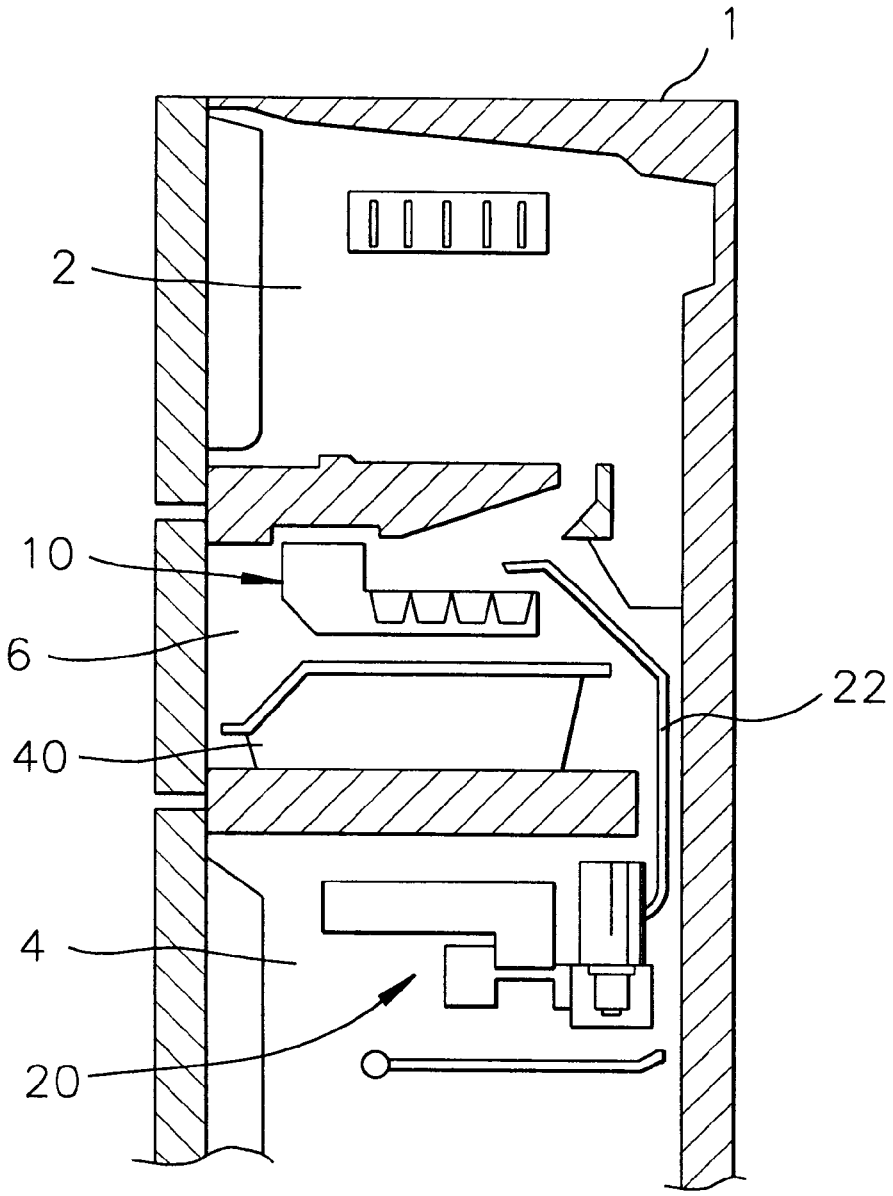
FIG. 1 (PRIOR ART)
FIG. 1 shows a cross sectional view for showing an internal structure of a prior art automatic ice making apparatus in a refrigerator.
Figure 2:
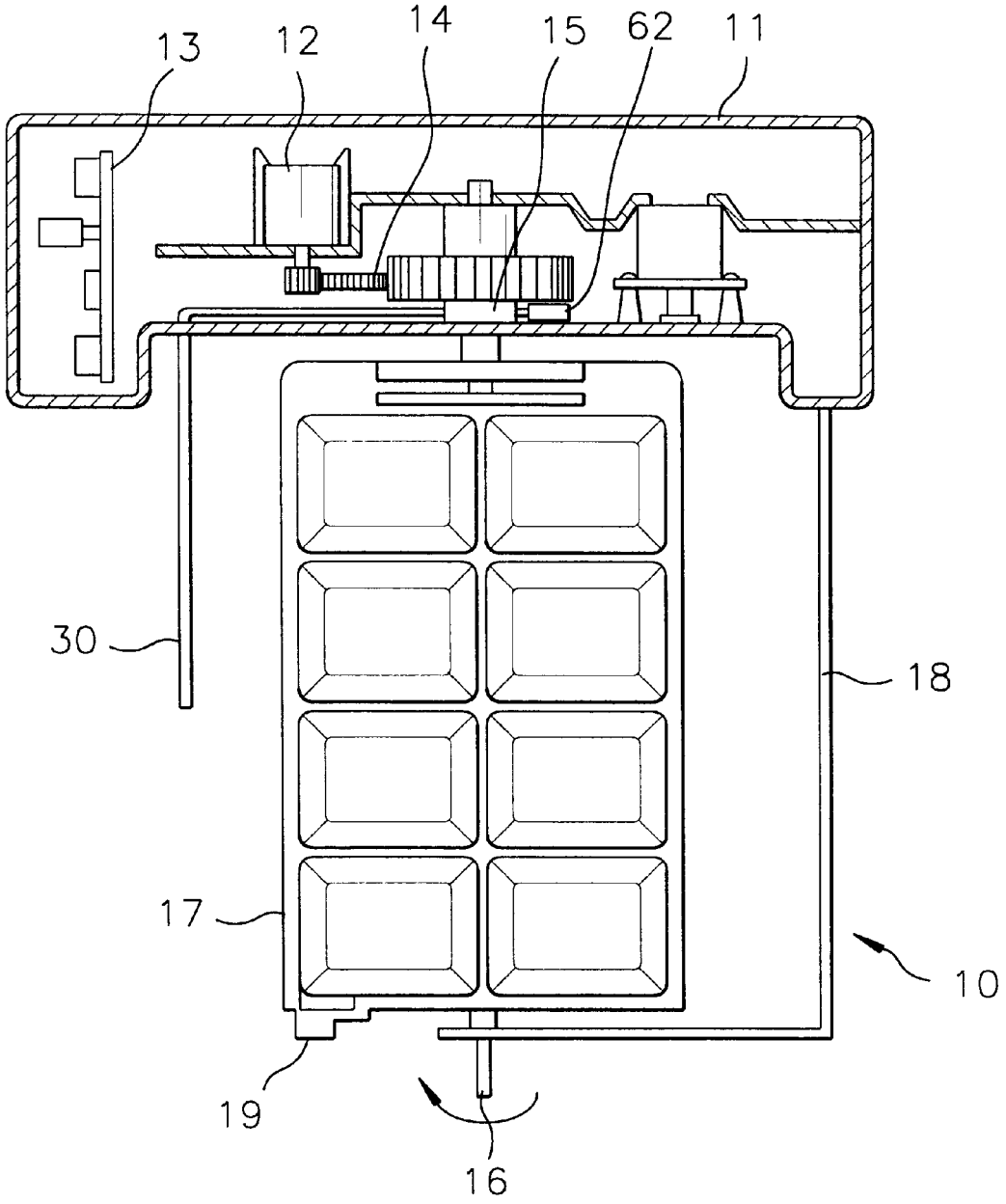
FIG. 2 (PRIOR ART)
FIG. 2 represents a schematic top plan view of an ice maker of the automatic ice making apparatus in FIG. 1.
Figure 3A:
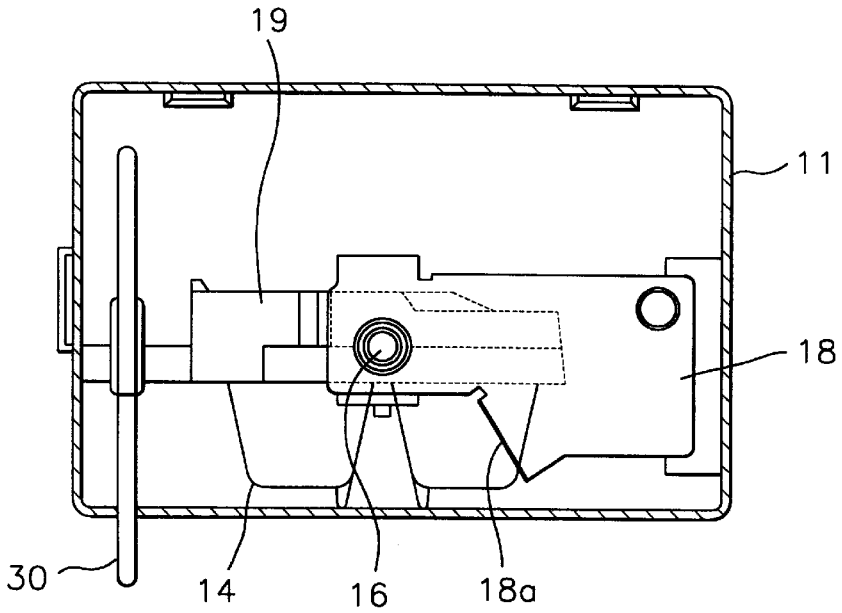
FIG. 3A (PRIOR ART)
FIGS. 3A and 3B are rear views of an ice tray in FIG. 2 illustrating the ice making operation and the ice removing operation thereof.
Figure 3B:
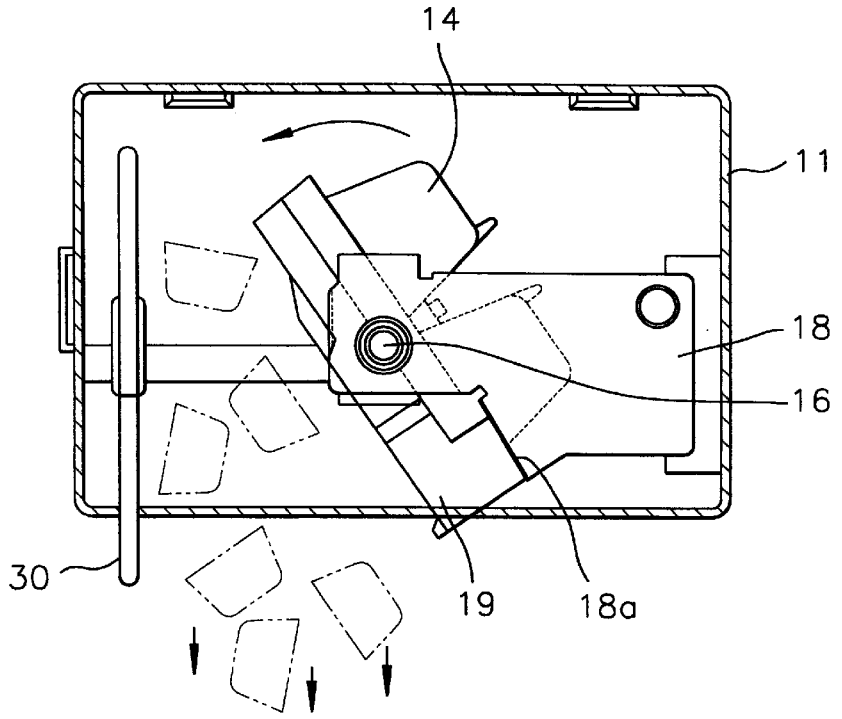
FIG. 3B (PRIOR ART)
Figure 4:
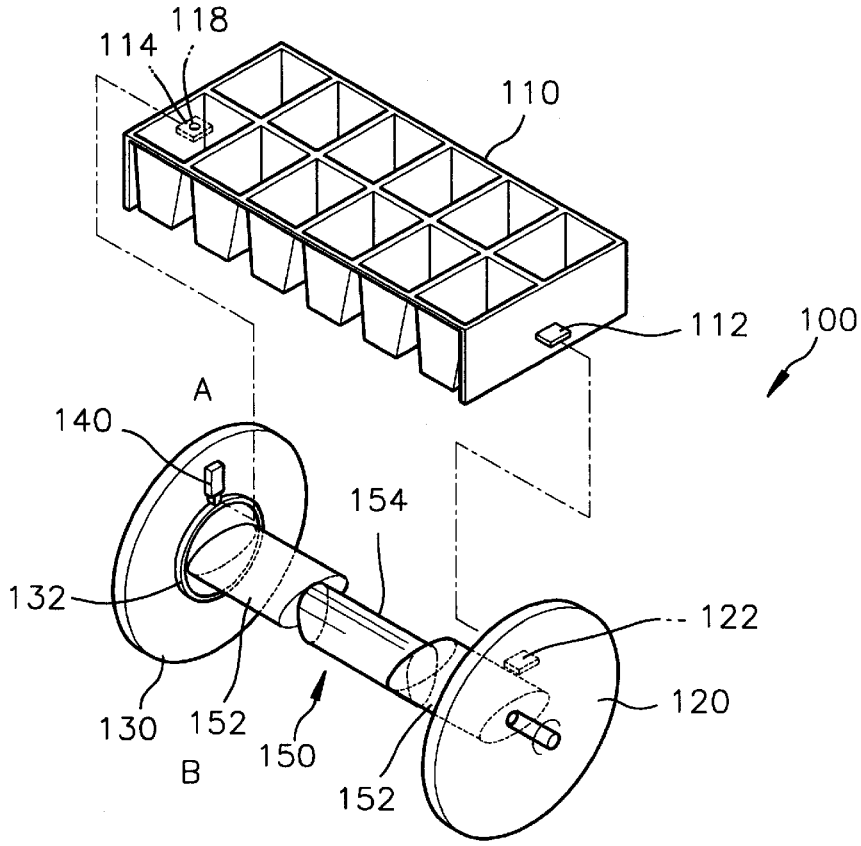
FIG. 4 depicts an exploded perspective view showing an ice removing mechanism of an automatic ice making apparatus in accordance with a preferred embodiment of the invention.

Referring to FIG. 4, there is shown an ice removing mechanism in accordance with a preferred embodiment of the present invention. As shown, the ice removing mechanism 100 includes an ice tray 110 having a fixing projection 112 at one end thereof, a sliding projection 114 at the other end thereof, and a plurality of cavities, into each of which water is supplied and is frozen to form ice cubes, a rotating guide plate 120, a fixing guide plate 130, a movable stopper 140 and a twisting member 150. The sliding projection 114 of the ice tray 110 has an opening hole 118.

The rotating guide plate 120 is provided with a connecting shaft 116 integrally connected to an output shaft(not shown) of a motor(not shown) at an outer side thereof and a fixing groove 122 at an inner side thereof. The fixing guide plate 130 has a guide groove 132 concentrically disposed to a center thereof. The fixing projection 112 and the sliding projection 114 of the ice tray 110 are inserted into the fixing groove 122 of the rotating guide plate 120 and the guide groove 132 of the fixing guide plate 130, respectively. Further, it is preferred that the rotating radius of the guide groove 132 is the same as a distance from a center of the rotating guide plate 120 to the fixing groove 122. When the rotating guide plate 120 is rotated, the sliding projection 114 of the ice tray 110 is slid along the guide groove 132 of the fixing guide plate 130.

Mounted between the rotating guide plate 120 and the fixing guide plate 130 is the twisting member 150 which is provided with both end portions 152 being in contact with the ice tray 110 and a pressing portion 154 disposed between the end portions 154 and downwardly projected therefrom to thereby press a bottom surface of the ice tray 110 during the rotation of the rotating guide plate 120.

Figure 5A:
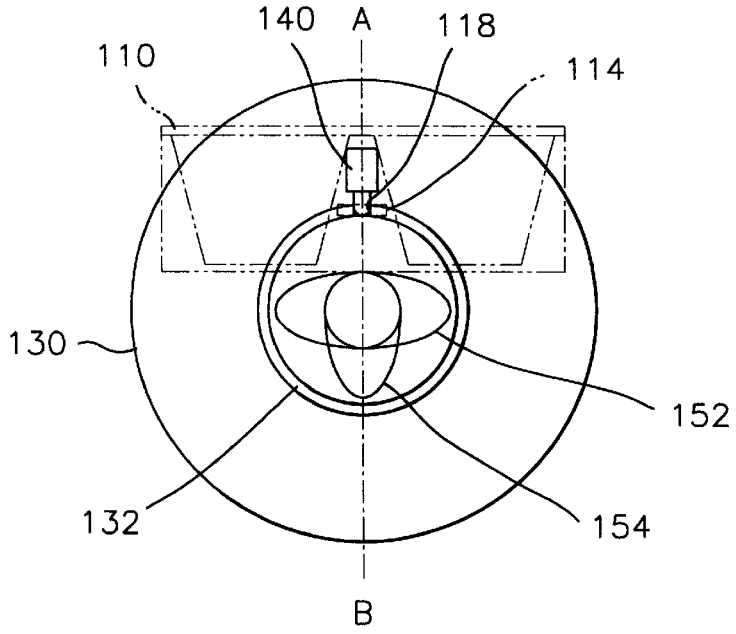
FIGS. 5A to 5C present rear views illustrating an ice removing operation of the ice removing mechanism shown in FIG. 4.
Figure 5B:
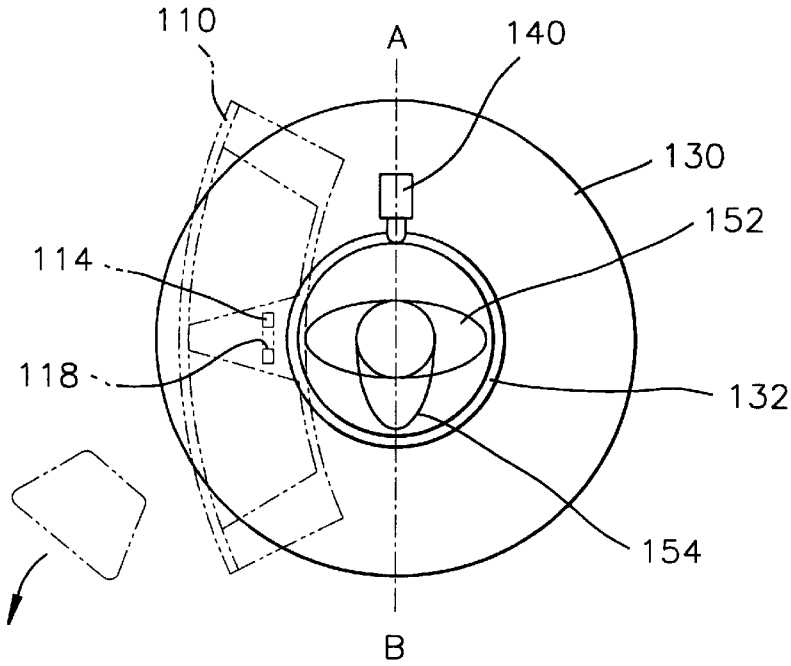
Figure 5C:
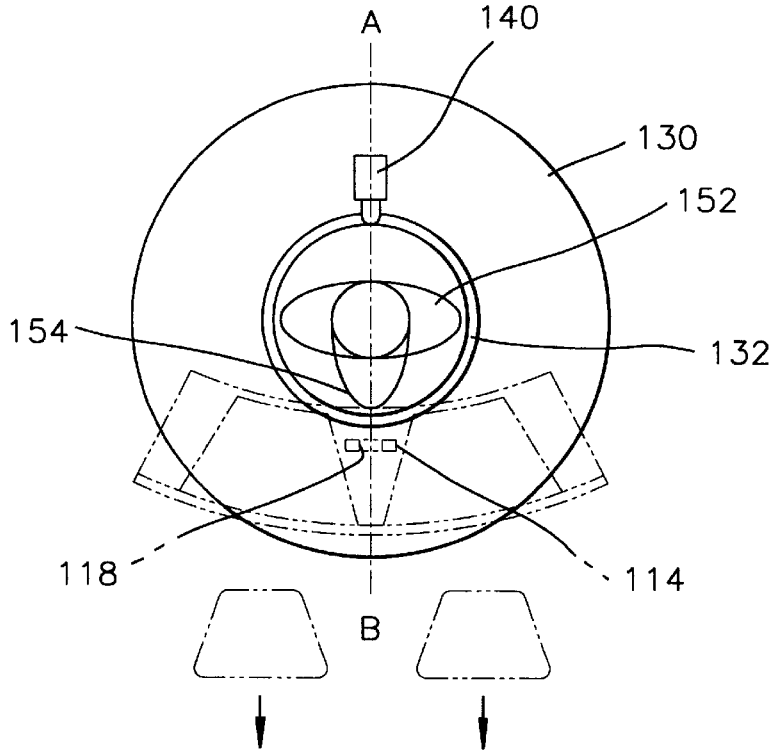

When the ice tray 110 is not in an ice removing operation, i.e., water supplying stage or ice making stage, the movable stopper 140 is inserted into the guide groove 132 of the fixing guide plate 130 to thereby prevent the ice tray 110 from rocking from side to side as shown in a position A of FIG. 5A. When the movable stopper 140 is released to thereby rotate the ice tray 110 in order to perform the ice removing operation, the ice tray 110 is twisted and rotated during the rotation of the rotating guide plate 120 since the fixing projection 112 of the ice tray 110 is inserted into the fixing groove 122 and the sliding projection 132 thereof is slid along the guide groove 132. Then, when the ice tray 110 is rotated in an angle of 90 degrees as shown a position B of FIG. 5B, a center of the ice tray 110 is pressed by both end portions 152 of the twisting member 150, thereby further twisting the ice tray 110. Thereafter, the ice try 110 is turned upside down as shown in FIG. 5C. As a result, the pressed ice tray 110 is released and then pressed again by the pressing portion 154 to thereby improve an ice removing force in such a way that the ice cubes are completely removed from the ice tray 110.

While the present invention has been described with respect to the preferred embodiment, it will be understood by those skilled in the art that certain changes and modifications may be made without departing from the scope of the invention as defined in the following claims.

What is claimed is:

1. An ice making apparatus for use in a refrigerator incorporating therein an ice removing mechanism having a motor and an output shaft connected thereto, the ice removing mechanism comprising:

an ice tray having a fixing projection at one end thereof and a sliding projection at the other end thereof;

means for twisting the ice tray and connected to the output shaft of the motor; and a movable stopper for preventing the ice tray from rocking from side to side, wherein the twisting means includes a rotating guide plate having a fixing groove at one side thereof to guide the fixing projection of the ice tray inserted thereinto and a connecting shaft rotatably connected to the output shaft at the other side thereof, a fixing guide plate having a guide groove concentrically disposed to a center thereof so as to allow the sliding projection of the ice tray to slide along the guide groove, and a twisting member disposed between the rotating plate and the fixing plate to press a bottom surface of the rotated ice tray during the rotation of the rotating guide plate to thereby remove ice cubes from the ice tray.

2. The apparatus according to claim 1, wherein the twisting member is provided with both end portions being in contact with the ice tray and a pressing portion disposed between the end portions and downwardly projected therefrom.

3. The apparatus according to claim 1, wherein the rotating radius of guide groove is the same as a distance from a center of the rotating guide plate to the fixing groove.

* * * * *